US008544185B2

(12) United States Patent
Bang

(10) Patent No.: US 8,544,185 B2
(45) Date of Patent: Oct. 1, 2013

(54) DRYER

(75) Inventor: Jong Chul Bang, Changwon-si (KR)

(73) Assignee: LG Electronics Inc., Seoul (KR)

( * ) Notice: Subject to any disclaimer, the term of this patent is extended or adjusted under 35 U.S.C. 154(b) by 1197 days.

(21) Appl. No.: 10/721,179

(22) Filed: Nov. 26, 2003

(65) Prior Publication Data

US 2004/0103556 A1 Jun. 3, 2004

(30) Foreign Application Priority Data

Nov. 28, 2002 (KR) ..... P2002-75019

(51) Int. Cl.
*D06F 58/00* (2006.01)

(52) U.S. Cl.
USPC ..... 34/132; 34/563

(58) Field of Classification Search
USPC ..... 34/595, 132, 134, 553, 604, 603; 219/537, 486
See application file for complete search history.

(56) References Cited

U.S. PATENT DOCUMENTS 2,830,384 A * 4/1958 Zehrbach ..... 34/604
3,857,016 A * 12/1974 Meyer et al. ..... 392/383
4,700,495 A * 10/1987 Drews et al. ..... 34/603
4,941,270 A * 7/1990 Hoffman ..... 34/60
5,334,818 A * 8/1994 Edwards et al. ..... 219/539
5,925,273 A * 7/1999 Sherrill ..... 219/478

* cited by examiner

*Primary Examiner* — Kenneth Rinehart
(74) *Attorney, Agent, or Firm* — KED & Associates LLP

(57) ABSTRACT

A dryer with an improved arrangement of heating coils is provided. The improved heater assembly includes a heater case partitioned into an upper passage and a lower passage, with independent first and second coil arrays crossing the plate between the upper and lower passages. The first and second coil arrays may be separately controlled to adjust an amount of drying capacity provided to the dryer while maintaining a uniform flow of drying air.

30 Claims, 3 Drawing Sheets

DRYER

This application claims the benefit of Korean Application (s) No. 10-2002-0075019 filed on Nov. 28, 2002 which is/are hereby incorporated by reference.

BACKGROUND OF THE INVENTION

1. Field of the Invention

The present invention relates to a dryer having an improved arrangement of heating coils.

2. Discussion of the Related Art

Generally, a laundry dryer is an apparatus for drying an object to be dried by blowing hot air generated from a heater assembly into a space holding the object. The dryer is equipped with a drying function. Yet, there is a washing machine equipped with the drying function as well.

A drum is rotatably provided in the dryer to hold the object to be dried. As the drum rotates, the object in the drum is lifted up to fall. In doing so, the dry hot air discharged from the heater assembly is blown into the drum to dry the falling object.

A heater assembly according to a related art consists of a heater case, a plate, an upper coil array, and a lower coil array.

The heater case is provided in the dryer, and the plate is provided parallel between air inlet and outlet of the heater case. The upper coil array is plurally arranged in a row over the plate to be heated in one body, and the lower coil array is plurally arranged in a row under the plate to be heated in one body. It is controlled that one of the upper and lower coil arrays emits heat or that both of the upper and lower coil arrays emit heat.

An operation of the related art dryer is explained as follows.

First of all, in the heater assembly, when power is applied to both of the upper and lower coil arrays, coils of the upper and lower coil array generate heat. Air flowing over the plate passes through the coils of the upper coil array to be heated and is then discharged. Air flowing under the plate passes through the coils of the lower coil array to be heated and is then discharged.

Meanwhile, if the power is applied to the upper coil array only, the air flowing over the plate is heated by the coils of the upper coil array to be discharged later. Yet, the air flowing under the plate fails to be heated.

In the related art heater assembly of the dryer, if the power is applied to one of the upper and lower coil arrays, temperature rise is concentrated on the heater case in the vicinity of the turned-on coil array only. The air around the turned-off coil array fails to be heated and is then discharged. Hence, drying performance is reduced.

SUMMARY OF THE INVENTION

Accordingly, the present invention is directed to a dryer that substantially obviates one or more of the problems due to limitations and disadvantages of the related art.

An object of the present invention, which has been devised to solve the foregoing problem, lies in providing a dryer, by which it is prevented that a heater case is locally heated.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a dryer including a cabinet, a drum, a motor, and a heater assembly including a heater case having an air passage inside, a plate partitioning the air passage into an upper passage and a lower passage, and first and second coil arrays independently provided to the air passage to alternately cross the plate between the upper and lower passages.

In this case, the first coil array leaves a predetermined distance from the second coil array. Moreover, the first coil array is symmetrical to the second coil array centering on the plate.

Meanwhile, each of the first and second coil arrays is electrically connected in one body. And, a plurality of coils are provided to top and bottom points of the first and second coil arrays, respectively. In this case, the top and bottom points lie on centerlines of the upper and lower passages, respectively. And, the coils provided to the first coil array leave a predetermined interval along a flowing direction of air from the other coils provided to the second coil array, respectively.

Preferably, the first and second coil arrays are alternately zigzagged to cross the plate. Moreover, the first and second coil arrays are separately controlled.

In another aspect of the present invention, there is provided a heater assembly of a dryer including a heater case having an air passage inside, a plate partitioning the air passage into an upper passage and a lower passage, and first and second coil arrays independently provided to the air passage to alternately cross the plate between the upper and lower passages.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENT(S)

Reference will now be made in detail to the preferred embodiment(s) of the present invention, examples of which are illustrated in the accompanying drawings. Throughout the drawings, like elements are indicated using the same or similar reference designations where possible.

Figure 1:
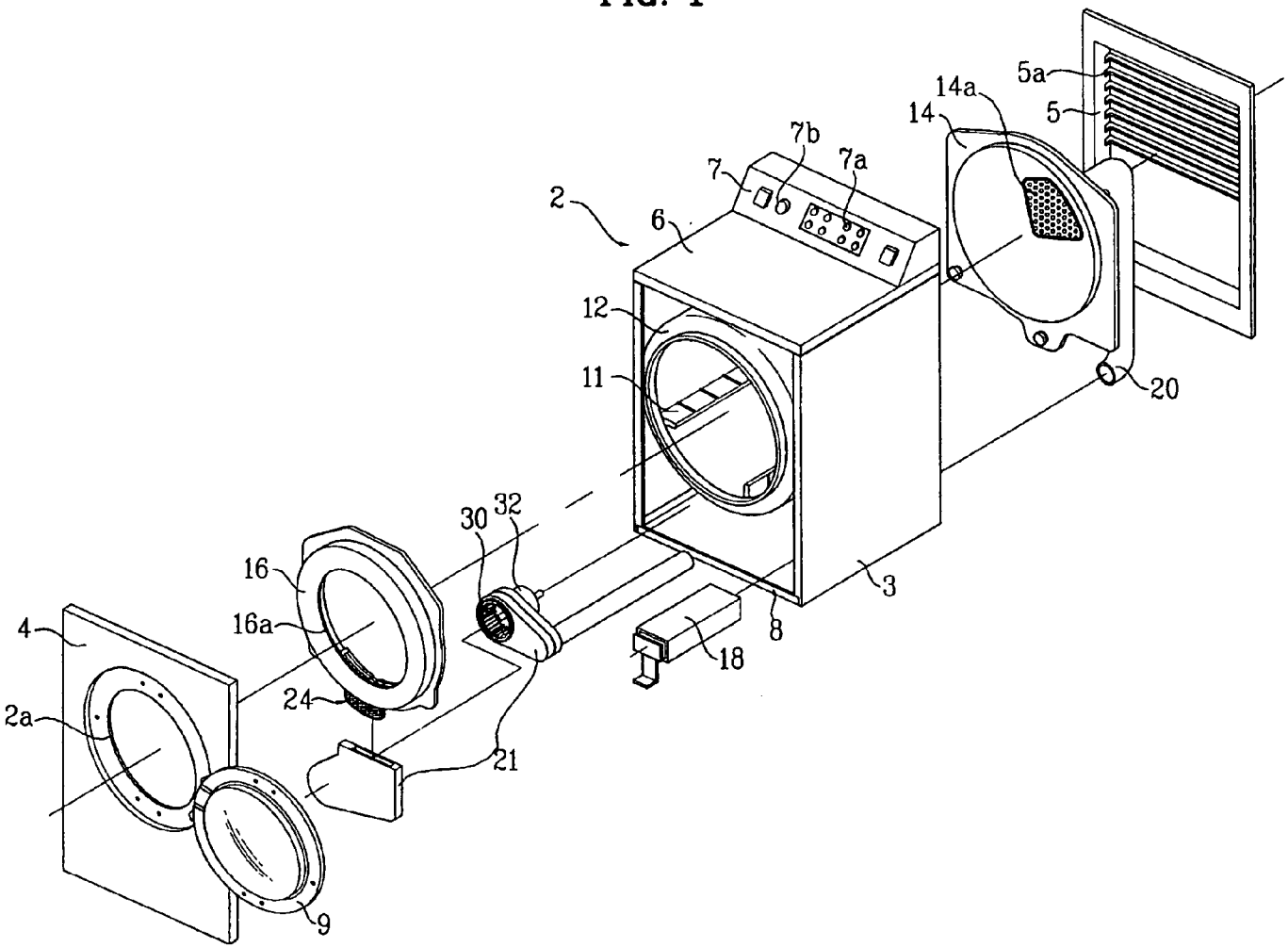
FIG. 1 is a perspective view of a disassembled dryer according to the present invention.
Figure 2:
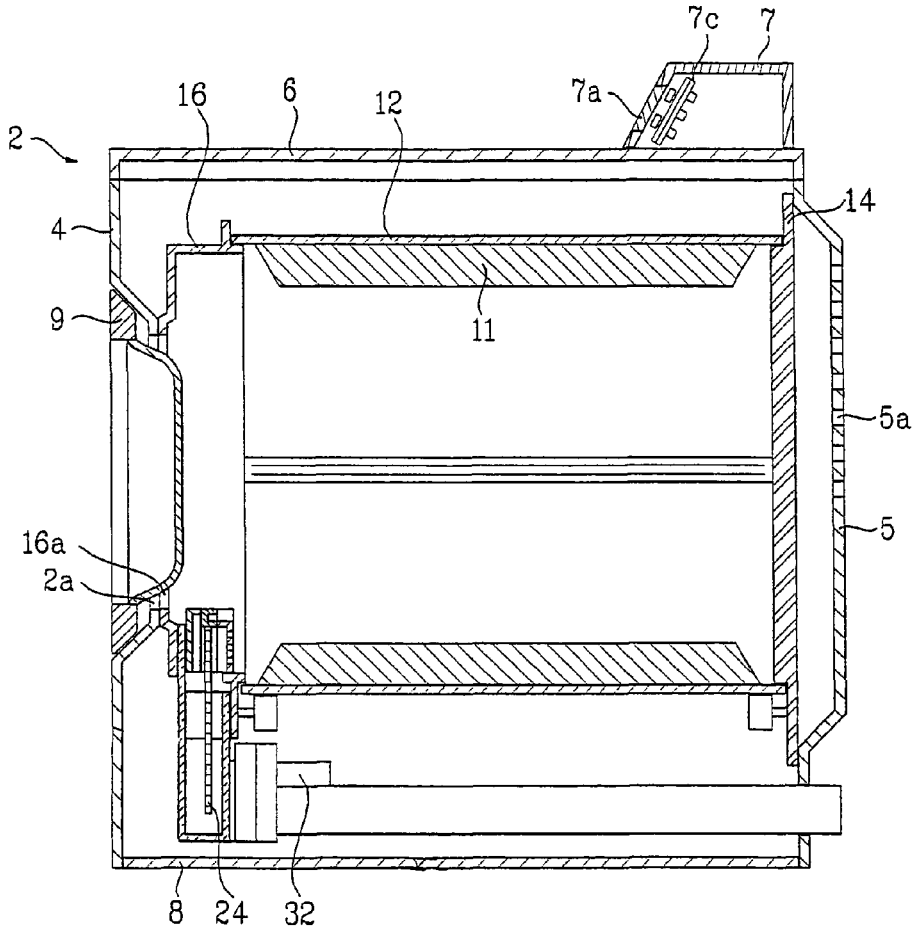
FIG. 2 is a cross-sectional view of a dryer according to the present invention.

FIG. 1 is a perspective view of a disassembled dryer according to the present invention and FIG. 2 is a cross-sectional view of a dryer according to the present invention.

Referring to FIG. 1 and FIG. 2, a dryer according to the present invention includes a case 2, a drum 12, a heater assembly 18, an inlet duct 20, an outlet duct 21, a filter 24, a fan 30, and a motor 32.

The case 2 forms an exterior of the dryer. The drum 12 is rotatably provided inside the case 2. An object to be dried is held in the drum 12, and a plurality of lifters 11 protrude from an inner circumference of the drum 12 to lift up the object to fall.

The heater assembly 18 is provided outside the drum 12. Dry hot air having passed through the heater assembly 18 is supplied to the drum 12 via the inlet duct 20. Air circulates throughout the drum 12 to absorb dampness of the objects and is then discharged outside via the outlet duct 21.

In this case, the filter 24 purifying the sucked air and the fan 30 blowing the air are provided to the outlet duct. The fan 30 and the drum 12 are rotated by the driven motor 32.

Meanwhile, the case 2 includes a cabinet 3, a front panel 4, a back panel 5, a top cover 6, a control panel 7, and a base 8.

The front panel 4 having an opening 2*a* formed at its central part is provided to a front side of the cabinet 3. A door 9 opening/closing the opening 2*a* is rotatably installed is at the front panel 4.

A multitude of intake holes 5*a* are formed at the back panel 5 that is provided at a rear side of the cabinet 3. The top cover 6 is provided over the cabinet 3. A control panel 7 having an operation display unit 7*a*, an operation control unit 7*b*, and a control unit 7*c* is provided on a rear part of an upper surface of the top cover 6. And, the base 8 is provided under the cabinet 3 to support a bottom of the dryer.

A front supporter 16 is provided in rear of the front panel 4 to rotatably support a front end of the drum 12, and a rear supporter 14 is provided in front of the back panel 5 to rotatably support a rear end of the drum 12.

A hole 16*a* is formed at the front supporter 16 to correspond to the opening 2*b* through which the object to be dried is put in or pulled out. Moreover, a net 14*a* is provided at an upper part of the rear supporter 14 to communicate with an upper end of the inlet duct 20.

Meanwhile, a plurality of coils are provided inside the heater assembly 18 to cross the plate repeatedly. Hence, air sucked into the case 2 passes the coils to be heated and dried.

Figure 3:
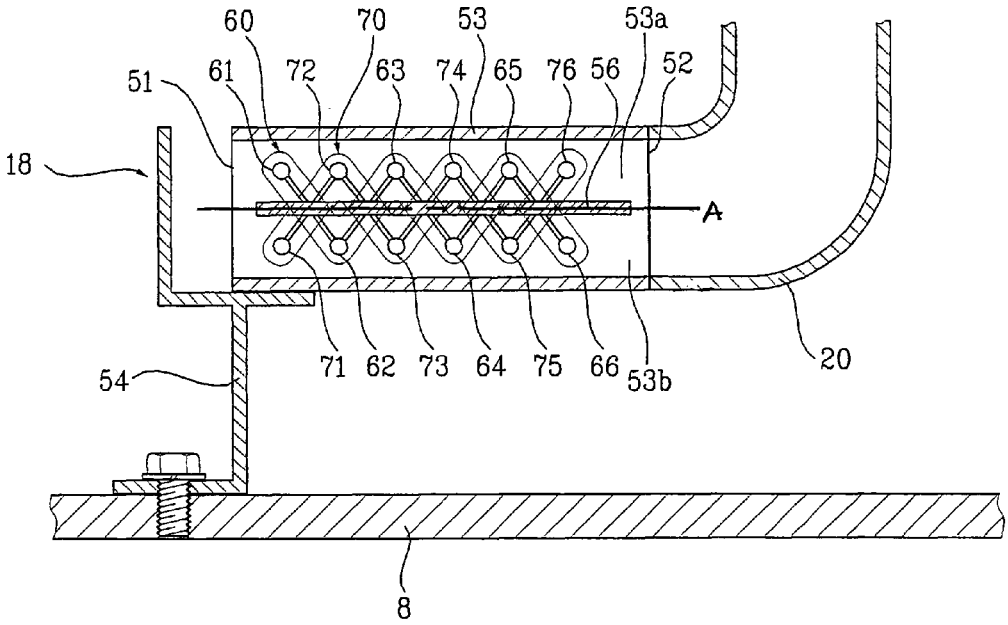
FIG. 3 is a cross-sectional view of a heater assembly according to the present invention.

FIG. 3 is a cross-sectional view of a heater assembly according to the present invention.

Referring to FIG. 3, the heater assembly 18 includes a heater case 53, a plate 56, a first coil array 60, and a second coil array 70.

The heater case 53 has a hollow box form, and its inner space forms an air passage. An air inlet 51 and an air outlet 52 are formed at front and rear ends of the heater case 53, respectively.

The plate 56 partitions the inner space of the heater case 53 into an upper part and a lower part. Namely, the plate 56 is provided along an axial axis of the heater case 53 to divide the inner space of the heater case 53 into an upper passage 53*a* and a lower passage 53*b*.

In this case, the upper passage 53*a* is a passage between an upper surface of the plate 56 and an upper inside of the heater case 53, and the lower passage 53*b* is a passage between a lower surface of the plate 56 and a lower inside of the heater case 53.

The first coil array 60 is zigzagged between the upper and lower passages 53*a* and 53*b* partitioned by the plate 56. A plurality of first heating coils 61 to 66 are provided to top and bottom points of the first coil array 60. In this case, the respective coils 61 to 66 play a role of resistors to radiate heat. Moreover, the first coil array 60 is connected to one power source overall.

And, the second coil array 70 is zigzagged between the upper and lower passages 53*a* and 53*b* partitioned by the plate 56. A plurality of second heating coils 71 to 76 are provided to top and bottom points of the second coil array 70.

In this case, the second coils 71 to 76 are arranged to leave a predetermined distance from the first heating coils 61 to 66, respectively, and are connected to one power source overall to radiate heat. Namely, the first coil array 60 is electrically independent from the second coil array 70.

Moreover, the first heating coils 61-66 provided to the first coil array 60 are positioned so as to leave a predetermined distance along an air-flowing direction from corresponding second heating coils 71-76 provided to the second coil array 70. Preferably, the plurality of first heating coils 61 to 66 and the plurality of second heating coils 71 to 76 are zigzagged so as to cross each other and be symmetrical between the upper and lower sides of the plate 56 about a line of symmetry A which is substantially coincident with the plate 5*b*.

In this case, the air inlet 51 of the heater case is fixed to a top of a heater mount 54 installed vertically on the base 8, and the air outlet 53 is fixed to a lower end of the inlet duct 20 so as to communicate with the inlet duct 20. Moreover, the heater case 53 is fixed to leave a predetermined interval from the upper surface of the base 8.

The top and bottom points of the heating coils 61-66 and 71-76 in each of the first and second coil arrays 60 and 70, respectively, are disposed on centerlines of the upper and lower passages 53*a* and 53*b*, respectively. Namely, the heating coils lie on the centerlines of the corresponding passage, thereby enabling an optimal heat-exchange with the flowing air.

The first and second coil arrays 60 and 70 are individually controlled by the control unit 7*c* of the dryer. In case of fast drying or a large amount of the object to be dried, power is applied to both of the first and second coil arrays 60 and 70.

Meanwhile, in case that an amount of the object to be dried is small or the object vulnerable to heat is dried, power is applied to one of the first and second coil arrays 60 and 70.

An operation of the dryer according to the present invention is explained as follows.

First of all, the object to be dried is put in the drum 12, and the operation control unit 7*b* is operated to drive the dryer. In doing so, the control unit 7*c* supplies power to the heater assembly 18 and the motor 32.

The control unit 7*c* individually applies power to the first and/or second coil array(s) 60/70 according to an operational signal of the operation control unit 7*b*. Namely, the first and second coil arrays 60 and 70 are independently controlled from each other.

If the power is applied to the first coil array 60, the first heating coils 61 to 66 are heated. If the power is applied to the second coil array 70, the second heating coils 71 to 76 are heated.

Meanwhile, once the drum 12 is rotated by the driven motor 32, the object in the drum 12 is lifted up by the lifts 11 to be raised to a predetermined height and falls down.

Moreover, once the driven motor 32 rotates the fan 30, a blowing pressure is generated in the outlet duct 21, drum 12, inlet duct 20, and inner space of the heater assembly 18.

External air is sucked into the air intake holes 5*a* by the blowing pressure and then flows in the air inlet 51 of the heater case 53. The air flowing in the heater case 53 passes through both of the upper and lower passages 53*a* and 53*b* separated from each other by the plate 56 to be dried and heated.

In case of fast drying or a large amount of the object to be dried, power is applied to both of the first and second coil arrays 60 and 70, whereby both of the first and second heating coils 61 to 66 and 71 to 76 radiate heat.

Specifically, the first heating coils 61, 63, and 65, and the second heating coils 72, 74, and 76 provided over the plate 56 dry/heat the air passing through the upper passage 53*a*, while the first heating coils 62, 64, and 66, and the second heating coils 71, 73, and 75 positioned under the plate 56 dry/heat the air passing through the lower passage 53*b*.

Meanwhile, in case that an amount of the object to be dried is small or the object vulnerable to heat is dried, power is applied to either the first or second coil array 60 or 70.

For instance, if the power is applied to the first coil array 60 only, the first heating coils 61, 63, and 65 over the plate 56 dry/heat the air passing thorough the upper passage 53*a* and the first heating coils 62, 64, and 66 under the plate 56 dry/heat the air passing thorough the lower passage 53*b*.

The dried/heated air passes through the inlet duct 20 and the net 14*a* in turn to be supplied to the rotating drum 12. In doing so, the air is brought contact with the object, which is lifted to fall, to dry.

The air absorbs the moisture from the object to be wet, passes through the filter 24 to be purified, and is discharged in a rear direction of the drier via the outlet duct 21.

Accordingly, the dryer according to the present invention has the following advantages of effects.

First of all, the heating coils of each of the coil arrays alternately cross the upper and lower passage. Therefore, the present invention enables to prevent the heater case from being heated locally and intensively even if power is applied to one of the coil arrays only.

Secondly, each coil array of the dryer is individually connected to the power source. Therefore, the present invention efficiently performs the drying by operating a single coil array.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A dryer, comprising:

a cabinet;

a drum provided in the cabinet and in rotational communication with a motor; and a heater assembly coupled to the drum, comprising:

a heater case having an air passage formed therein;

a plate that partitions the air passage into an upper passage and a lower passage; and independent first and second coil arrays provided in the air passage, wherein the first coil array crosses the plate multiple times such that a plurality of first coils of the first coil array are alternately positioned in the upper and lower passages, and the second coil array crosses the plate multiple times such that a plurality of second coils of the second coil array are alternately positioned in the upper and lower passages, wherein the first and second coils positioned in the upper passage form an alternating pattern in the upper passage, and the first and second coils positioned in the lower passage form an alternating pattern in the lower passage such that each of the plurality of first coils is positioned substantially directly across from a corresponding second coil of the plurality of second coils on the opposite side of the plate.

2. The dryer as claimed in claim 1, wherein the plurality of first coils of the first coil array are positioned at a predetermined distance from the plurality of second coils of the second coil array.

3. The dryer as claimed in claim 1, wherein the first coil array is symmetrical to the second coil array along a predetermined line of symmetry of the air passage.

4. The dryer as claimed in claim 1, wherein the plurality of first coils of the first coil array are electrically connected as a single unit, and the plurality of second coils of the second coil array are electrically connected as a single unit that is separate from the first coil array.

5. The dryer as claimed in claim 1, wherein upper and lower portions of each of the first and second coil arrays are positioned along centerlines of the upper and lower passages, respectively.

6. The dryer as claimed in claim 1, wherein the plurality of coils of the first coil array are positioned at a predetermined interval along an air flow direction from the corresponding plurality of coils of the second coil array.

7. The dryer as claimed in claim 1, wherein the first and second coil arrays are configured to be separately controlled.

8. A heater assembly for a dryer, comprising:

a heater case having an air passage formed therein;

a plate that partitions the air passage into an upper passage and a lower passage; and independent first and second coil arrays provided in the air passage, wherein the first coil array comprises a plurality of first coils alternately positioned in the upper and lower passages, and the second coil array comprises a plurality of second coils alternately positioned in the upper and lower passages such that the first and second coils positioned in the upper passage form an alternating pattern in the upper passage, and the first and second coils positioned in the lower passage form an alternating pattern in the lower passage, wherein each of the plurality of first coils is positioned substantially directly across from a corresponding second coil of the plurality of second coils on the opposite side of the plate.

9. The heater assembly as claimed in claim 8, wherein the plurality of first coils of the first coil array are positioned at a predetermined distance from the plurality of second coils of the second coil array.

10. The heater assembly as claimed in claim 8, wherein the first coil array is symmetrical to the second coil array along a predetermined line of symmetry of the air passage.

11. The heater assembly as claimed in claim 8, wherein the plurality of first coils of the first coil array are electrically connected as a single unit, and the plurality of second coils of the second coil array are electrically connected as a single unit that is separate from the first coil array.

12. The heater assembly as claimed in claim 8, wherein upper and lower portions of each coil array are positioned along centerlines of the upper and lower passages, respectively.

13. The heater assembly as claimed in claim 8, wherein the plurality of first coils of the first coil array are positioned at a predetermined interval in an airflow direction from the corresponding plurality of second coils of the second coil array.

14. The heater assembly as claimed in claim 8, wherein the first and second coil arrays are configured to be separately controlled.

15. The dryer as claimed in claim 3, wherein the plate is positioned along the predetermined line of symmetry of the air passage.

16. The heater assembly as claimed in claim 12, wherein the plate is positioned along the predetermined line of symmetry of the air passage.

17. A dryer comprising the heater assembly of claim 10.

18. A heater assembly for a dryer, comprising:

a heater case;

a plate provided in the case so as to partition the case into an upper portion and a lower portion;

a first coil array comprising a plurality of first coils, the plurality of first coils comprising a plurality of upper first coils positioned in the upper portion of the case, and a plurality of lower first coils positioned in the lower portion of the case; and a second coil array comprising a plurality of second coils, the plurality of second coils comprising a plurality of upper second coils positioned in the upper portion of the case, and a plurality of lower second coils positioned in the lower portion of the case, wherein the plurality of upper first and second coils are arranged in the upper portion such that an upper first coil is disposed between two upper second coils and an upper second coil is disposed between two upper first coils so as to form an alternating pattern of upper first and second coils in the upper portion, and the plurality of lower first and second coils are arranged in the lower portion such that a lower first coil is disposed between two lower second coils and a lower second coil is disposed between two lower first coils so as to form an alternating pattern of lower first and second coils in the lower portion.

19. The heater assembly as claimed in claim 18, wherein the first coil array is configured to operate as a single unit, and wherein the plurality of first coils are arranged in the first coil array such that the upper and lower first coils form an alternating pattern.

20. The heater assembly as claimed in claim 19, wherein the first coil array crosses the plate each time the first coil array alternates between the upper and lower first coils so as to alternately position first coils in the upper and lower passages.

21. The heater assembly as claimed in claim 20, wherein the second coil array is configured to operate as a single unit independent of the first coil array, and wherein the plurality of second coils are arranged in the second coil array such that the upper and lower second coils form an alternating pattern.

22. The heater assembly as claimed in claim 21, wherein the alternating pattern formed by the upper and lower first coils is a mirror image of the alternating pattern formed by the upper and lower second coils.

23. The heater assembly as claimed in claim 21, wherein the second coil array is configured to cross the plate each time the second coil array alternates between the upper and lower second coils.

24. The heater assembly as claimed in claim 18, wherein the first and second coil arrays each form a zigzag pattern.

25. A dryer comprising the heater of claim 18.

26. A dryer, comprising:

a cabinet;

a drum provided in the cabinet and configured to be in rotational communication with a motor; and a heater assembly coupled to the drum, comprising:

a heater case having an air passage formed therein;

a plate positioned in the heater case so as to partition the air passage into an upper passage and a lower passage; and independent first and second coil arrays provided in the air passage, wherein the first coil array crosses the plate multiple times so as to alternately position a plurality of first coils thereof in the upper and lower passages, and the second coil array crosses the plate multiple times so as to alternately position a plurality of second coils thereof in the upper and lower passages such that the first and second coils positioned in the upper passage form an alternating pattern, and the first and second coils positioned in the lower passage form an alternating pattern, wherein each of the plurality of first coils is positioned substantially directly across from a corresponding second coil of the plurality of second coils on the opposite side of the plate, and wherein upper and lower portions of each of the first and second coil arrays are positioned along centerlines of the upper and lower passages, respectively.

27. The dryer as claimed in claim 1, wherein at least one of the plurality of first coils is positioned between two adjacent second coils, and at least one of the plurality of second coils is positioned between two adjacent first coils in each of the upper and lower passages.

28. The heater assembly as claimed in claim 8, wherein at least one of the plurality of first coils is positioned between two adjacent second coils, and at least one of the plurality of second coils is positioned between two adjacent first coils in each of the upper and lower passages.

29. The dryer as claimed in claim 26, wherein at least one of the plurality of first coils is positioned between two adjacent second coils, and at least one of the plurality of second coils is positioned between two adjacent first coils in each of the upper and lower passages.

30. The heater assembly as claimed in claim 8, wherein the independent first and second coil arrays each alternately cross the plate between the upper and lower passages multiple times so as to form the alternating patterns of first and second coils in the upper and lower passages.

* * * * *